US005403224A

United States Patent [19]

Gintling

[11] Patent Number: 5,403,224

[45] Date of Patent: Apr. 4, 1995

[54] PHOTOGRAPH FACE DOLL WITH REMOVABLE FACE POCKET

[76] Inventor: Edwin W. Gintling, 6135 Hillfield NW., N. Canton, Ohio 44720

[21] Appl. No.: 215,104

[22] Filed: Mar. 21, 1994

[51] Int. Cl.[6] ..... A63H 3/12; A63H 3/36

[52] U.S. Cl. ..... 446/321; 446/337; 446/391

[58] Field of Search ..... 446/391, 372, 337, 321, 446/97, 100, 220, 901; 273/DIG. 14, DIG. 30; 4/661, 159

[56] References Cited

U.S. PATENT DOCUMENTS

| | | | |
|---|---|---|---|
| 2,046,924 | 7/1936 | Pendergast | 446/901 X |
| 2,199,049 | 4/1940 | Greenberg | 446/100 |
| 2,592,078 | 4/1952 | Taylor et al. | 446/100 |
| 2,925,675 | 2/1960 | Lumpkin | 40/661 X |
| 3,940,778 | 2/1976 | Craig et al. | 40/159 X |
| 4,020,586 | 5/1977 | Benner | 446/391 X |
| 4,294,634 | 10/1981 | Mookil | 446/87 X |
| 5,074,593 | 12/1991 | Grosso | 40/661 X |
| 5,254,026 | 10/1993 | Kaiser | 446/220 |

FOREIGN PATENT DOCUMENTS

| | | | |
|---|---|---|---|
| 63186 | 6/1913 | Switzerland | 446/391 |
| 2013508 | 8/1979 | United Kingdom | 446/321 |

*Primary Examiner*—Robert A. Hafer
*Assistant Examiner*—D. Neal Muir

[57] ABSTRACT

A doll having a pocket secured to the face portion of the doll for displaying a photograph. The doll includes a doll body and a doll head with a pocket which may include a releasable sealing closure such that the photograph may be sealed within the pocket. Releasable fabric fasteners may be utilized to secure the pocket to the face portion, whereby the pocket may be selectively removed to facilitate both a reversing of the pocket and a washing of the doll or the like.

2 Claims, 3 Drawing Sheets

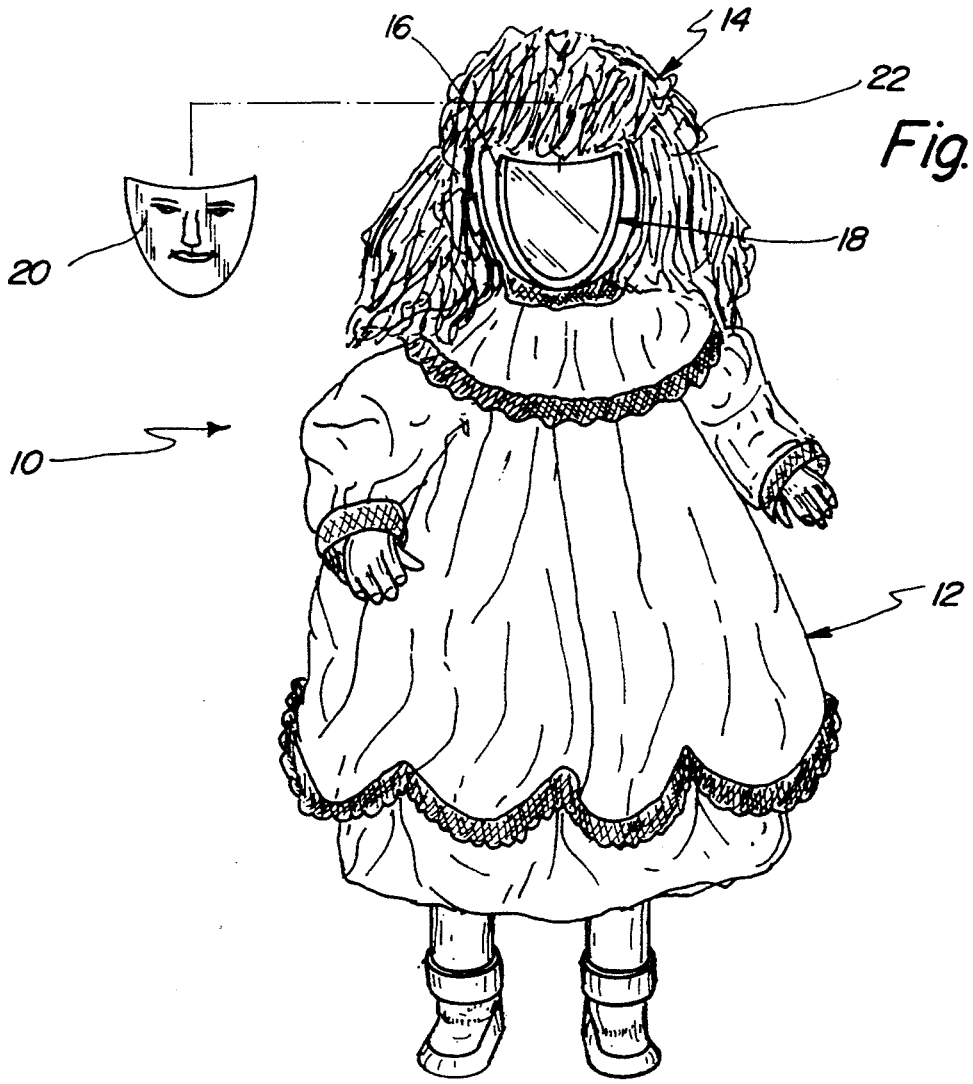
Fig. 1
Fig. 2
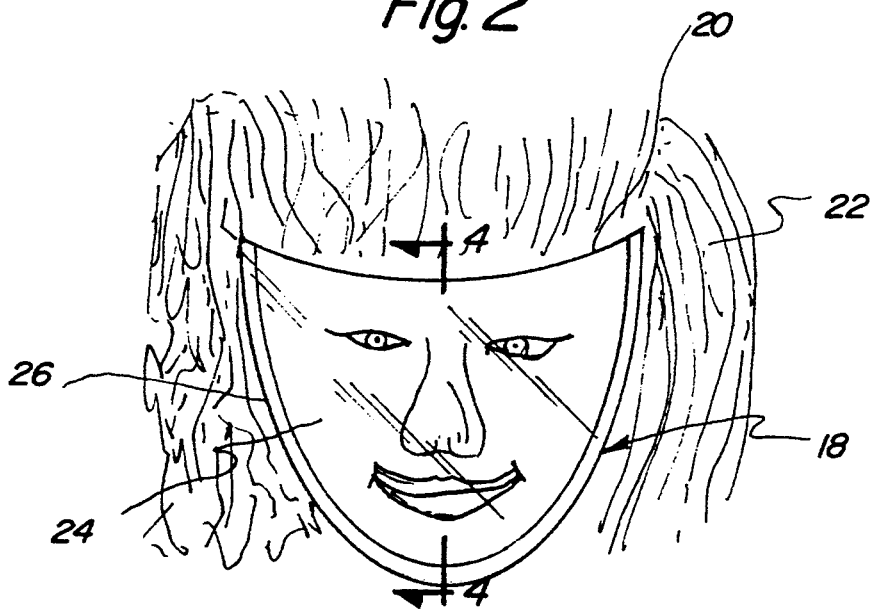

PHOTOGRAPH FACE DOLL WITH REMOVABLE FACE POCKET

BACKGROUND OF THE INVENTION

1. Field of the Invention

The present invention relates to dolls and more particularly pertains to a doll having a pocket secured to the face portion of the doll for displaying a photograph.

2. Description of the Prior Art

The use of dolls is known in the prior art. More specifically, dolls heretofore devised and utilized for the purpose of exhibiting changeable facial features are known to consist basically of familiar, expected and obvious structural configurations, notwithstanding the myriad of designs encompassed by the crowded prior art which have been developed for the fulfillment of countless objectives and requirements.

For example, a doll with an envelope for a photo image face is illustrated in U.S. Pat. No. 4,020,586 which is provided with a pocket means located in a face zone thereof to receive a photographic likeness of a person to personalize the doll.

Another patent of interest is U.S. Pat. No. 4,993,987 which teaches a doll having a personalized, photographic face, such as a mother's face, impregnated in the material of which the doll is constructed.

Other known prior art dolls include U.S. Pat. No. 5,009,626; U.S. Pat. No. 4,798,556; and U.S. Pat. No. 4,659,319.

While these devices fulfill their respective, particular objectives and requirements, the aforementioned patents do not disclose a doll having a pocket secured to the face portion of the doll for displaying a photograph in which the pocket includes a releasable sealing closure such that the photograph may be sealed within the pocket, and releasable fabric fasteners for securing the pocket to the face portion of the doll, whereby the pocket may be selectively removed to facilitate both a reversing of the pocket and a washing of the doll or the like.

In these respects, the photograph face doll according to the present invention substantially departs from the conventional concepts and designs of the prior art, and in so doing provides an apparatus primarily developed for the purpose of displaying a photograph upon the face portion of the doll.

SUMMARY OF THE INVENTION

In view of the foregoing disadvantages inherent in the known types of dolls now present in the prior art, the present invention provides a new photograph face doll construction wherein the same can be utilized for displaying a photograph upon the face portion of the doll. As such, the general purpose of the present invention, which will be described subsequently in greater detail, is to provide a new photograph face doll apparatus and method which has many of the advantages of the dolls mentioned heretofore and many novel features that result in a photograph face doll which is not anticipated, rendered obvious, suggested, or even implied by any of the prior art dolls, either alone or in any combination thereof.

To attain this, the present invention generally comprises a doll having a pocket secured to the face portion of the doll for displaying a photograph. The doll includes a doll body and a doll head with a pocket which may include a releasable sealing closure such that the photograph may be sealed within the pocket. Releasable fabric fasteners may be utilized to secure the pocket to the face portion, whereby the pocket may be selectively removed to facilitate both a reversing of the pocket and a washing of the doll and the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new photograph face doll apparatus and method which has many of the advantages of the dolls mentioned heretofore and many novel features that result in a photograph face doll which is not anticipated, rendered obvious, suggested, or even implied by any of the prior art dolls, either alone or in any combination thereof.

It is another object of the present invention to provide a new photograph face doll which may be easily and efficiently manufactured and marketed.

It is a further object of the present invention to provide a new photograph face doll which is of a durable and reliable construction.

An even further object of the present invention is to provide a new photograph face doll which is susceptible of a low cost of manufacture with regard to both materials and labor, and which accordingly is then susceptible of low prices of sale to the consuming public, thereby making such photograph face dolls economically available to the buying public.

Still yet another object of the present invention is to provide a new photograph face doll which provides in the apparatuses and methods of the prior art some of the advantages thereof, while simultaneously overcoming some of the disadvantages normally associated therewith.

Still another object of the present invention is to provide a new photograph face doll having a pocket secured to the face portion of the doll for displaying a photograph.

Yet another object of the present invention is to provide a new photograph face doll of the aforementioned structure in which the pocket is provided with a releasable sealing closure such that the photograph may be sealed within the pocket.

Even still another object of the present invention is to provide a new photograph face doll in which releasable fabric fasteners are utilized to secure the pocket to the face portion, whereby the pocket may be selectively removed to facilitate washing the doll and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a photograph face doll comprising the present invention.

FIG. 2 is an enlarged front elevation view of a portion of the present invention.

DESCRIPTION OF THE PREFERRED EMBODIMENT

Figure 3:
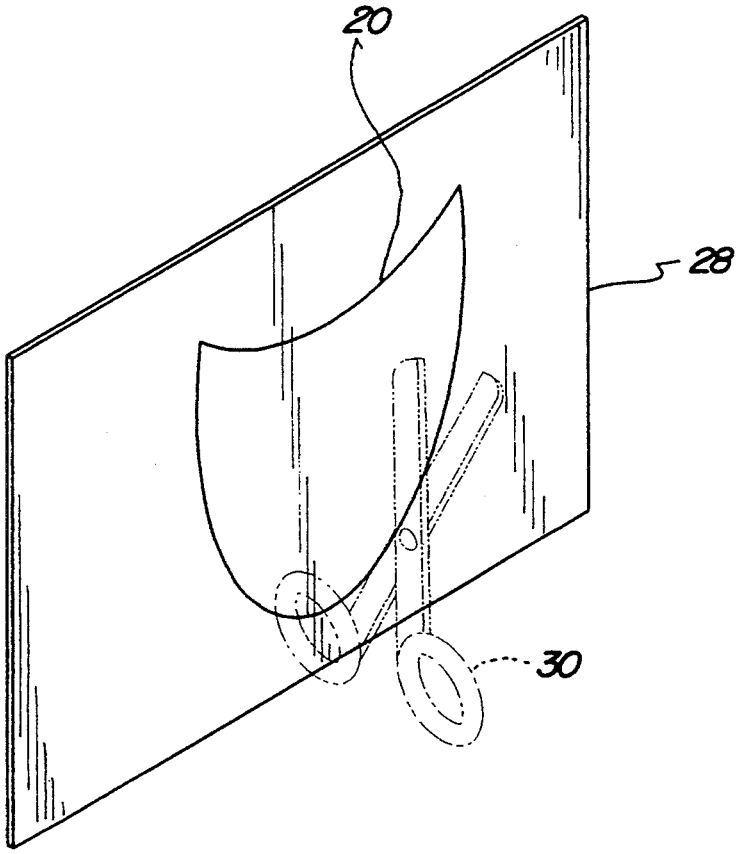
FIG. 3 is an isometric illustration of a photograph detailing a preparation of the photograph.

With reference now to the drawings, and in particular to FIGS. 1–6 thereof, a new photograph face doll embodying the principles and concepts of the present invention and generally designated by the reference numeral 10 will be described.

More specifically, it will be noted that the photograph face doll 10 comprises a doll body 12 which may be of any conceivable animal or human shape. For example, the doll body 12 may be shaped as a young female, as illustrated in FIG. 1, or as a young male, adult male, or adult female. A doll head 14 is coupled to the doll body 12 and has a face portion 16 to which a pocket 18 is mounted. The pocket 18 is operable to receive a photograph cutout 20, as best illustrated in FIG. 2. To partially conceal the pocket 18 and complete the doll head 14, a mass of hair 22 is provided upon the head.

Figure 4:
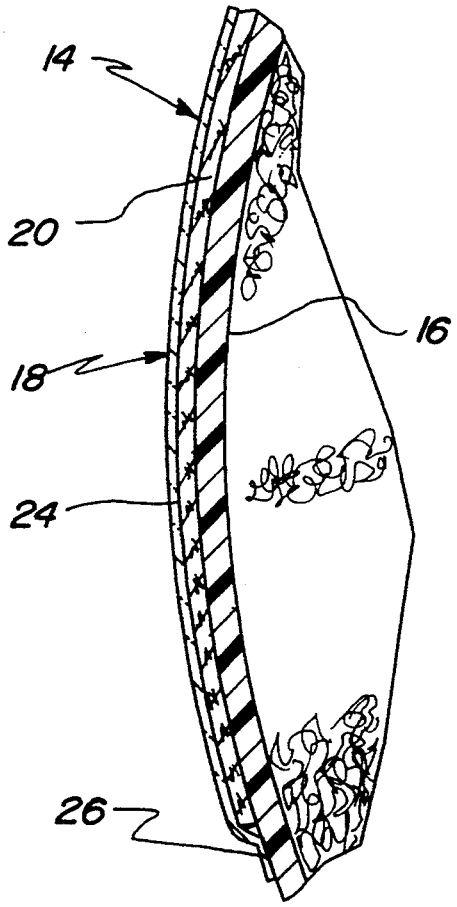
FIG. 4 is a cross sectional view taken along line 4—4 of FIG. 2.

As most clearly shown in FIGS. 2 and 4, the pocket 18 is formed of a substantially transparent outer panel 24 which is secured to the face portion 16 of the doll head 14 by a substantially U-shaped seam 26. The seam 26 may be formed by heat sealing if the face portion 16 and the outer panel 24 are of a thermoplastic material, or by sewing or other conventional joining means if the outer panel and the face portion are dissimilar.

Turning now to FIG. 3, it can be shown that a photograph 28 may simply be cut by a cutting means, such as scissors 30, to a shape suitable for placement within the pocket 18 to define the photograph cutout 20. Because the photograph cutout 20 may be selectively removed from the pocket 18, a number of such cutouts may be created from different photographs 28, whereby a changing of the facial expression of the doll may be easily and efficiently accomplished.

Figure 5:
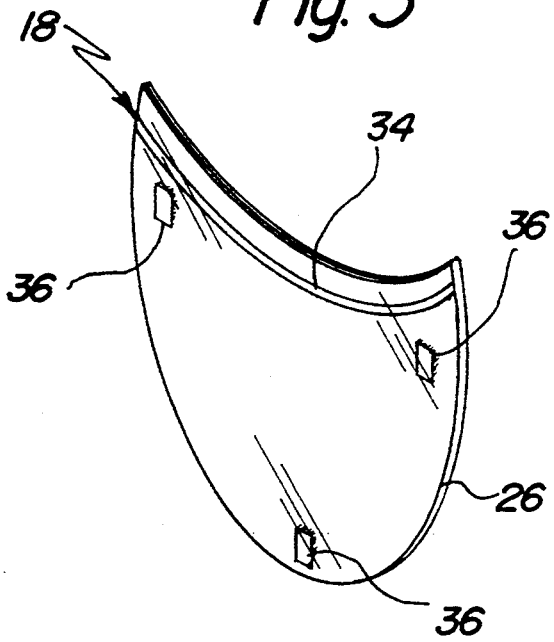
FIG. 5 is an isometric illustration of the pocket member.
Figure 6:
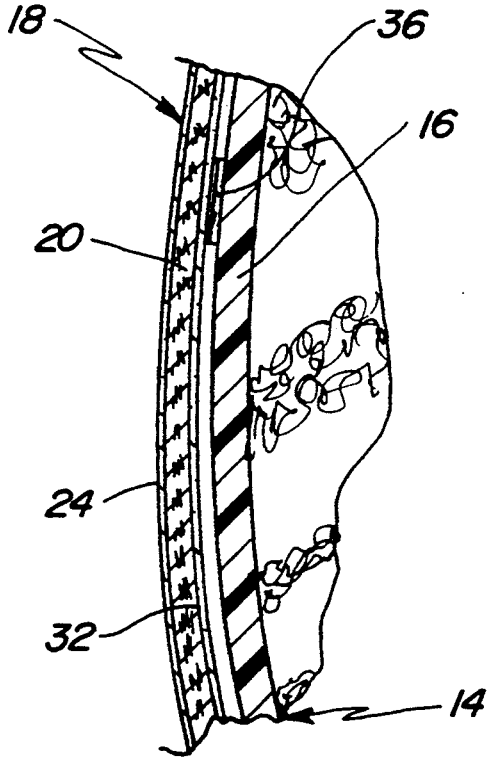
FIG. 6 is a cross sectional view illustrating attachment of the pocket member to the face portion of the doll.

Referring now to FIGS. 5 and 6 with concurrent reference to the Figures previously discussed, it can be shown that the pocket 18 may be formed of both the outer panel 24 and a similarly constructed inner panel 32 which are heat sealed, stitched, or otherwise coupled together along perimeter portions thereof to define the seam 26. In this construction, the seam 26 is formed between the panels 24, 32 and does not include the face portion 16. In addition, a releasable sealing closure 34 extends across an upper portion of the pocket 18, whereby the photograph cutout 20 may be captured within the pocket 18. In the preferred embodiment, the outer panel 24 and the inner panel 32 are heat sealed together around peripheries thereof to define a substantially water-tight seam 26. Similarly, the releasable sealing closure 34 is preferably water-tight, such that the photograph cutout 20 may be relasably sealed therewithin. By this structure, the photograph cutout 20 is effectively protected from fluids and other damaging elements.

The doll 10 may be constructed of washable materials such that the entire doll may be immersed within a cleaning fluid, such as by hand washing, machine washing, or the like. To protect the pocket 18 and its associated photograph cutout 20 from contact with such cleaning fluid during a washing process, the pocket 18 may be removed from the face portion 16 of the doll head 14. To this end, the pocket 18 is secured to the face portion 16 by a plurality of fasteners 36. The fasteners 36 may comprise hook and pile fasteners, releasable adhesive fasteners, snaps, buttons, or other similar conventionally known releasable fasteners. In the preferred embodiment, the fasteners 36 comprise releasable adhesive fasteners which remain secured to the face portion 16 of the head 14. By this structure, a pair of photograph cutouts 20 may be oppositely arranged within the pocket 18, whereby changing of the displayed photograph cutout may be quickly accomplished by simply reversing the pocket 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A photograph face doll comprising:

a doll body;

a doll head coupled to said doll body, said head having a face portion;

an adhesive fastener coupled to said face portion; and, a substantially transparent pocket for receiving a plurality of photograph cutouts therewithin, said pocket comprising a transparent outer panel and a transparent inner panel, said panels having a substantially similar shape and being coextensive relative to each other, said panels each having an arcuate perimeter and an upper portion and being permanently joined together along said arcuate perimeters thereof and having a releasable sealing closure extending along said upper portions thereof to effect a sealing enclosure of said plurality of photograph cutouts therewithin, whereby a first photograph cutout is positionable within said pocket for viewing through said outer panel thereof, and a second photograph cutout is positionable within said pocket for viewing through said inner panel thereof, wherein said inner panel is releasably coupled to said adhesive fastener to display said first photograph cutout through said outer panel, with said pocket being selectively removable from said adhesive fastener to permit coupling of said outer panel to said adhesive fastener to display said second photograph cutout through said inner panel of said pocket.

2. The photograph face doll of claim 1, and further comprising a mass of hair coupled to said doll head.

* * * * *